US005568692A

United States Patent [19]

Crompton et al.

[11] Patent Number: 5,568,692

[45] Date of Patent: Oct. 29, 1996

[54] PAINT DRYING OVEN WITH RADIANT ENERGY FLOOR

[75] Inventors: David W. Crompton, Ann Arbor; Gregory M. Still, Plymouth; Anthony R. Gore, Farmington Hills, all of Mich.

[73] Assignee: Durr Industries, Inc., Plymouth, Mich.

[21] Appl. No.: 336,483

[22] Filed: Nov. 9, 1994

[51] Int. Cl.[6] ..... F26B 3/34

[52] U.S. Cl. ..... 34/270; 34/666

[58] Field of Search ..... 34/266, 267, 270, 34/271, 272, 666; 250/492.1

[56] References Cited

U.S. PATENT DOCUMENTS

| | | | |
|---|---|---|---|
| 724,826 | 4/1903 | Dwight | 432/212 |
| 1,464,348 | 8/1923 | Ayres | 34/660 |
| 2,262,057 | 11/1941 | Shaw | 34/540 |
| 2,376,174 | 5/1945 | Munning et al. | 34/87 |
| 2,668,364 | 2/1954 | Colton | 34/266 |
| 2,790,250 | 4/1957 | Giroud | 34/207 |
| 3,016,442 | 1/1962 | Brach | 792/414 |
| 3,259,995 | 7/1966 | Powischill | 34/474 |
| 3,277,948 | 10/1966 | Best | 431/328 |
| 4,416,068 | 11/1983 | Nilsson et al. | 34/267 |
| 4,546,553 | 10/1985 | Best | 34/266 |
| 4,635,381 | 1/1987 | Hubbert | 34/571 |
| 5,070,625 | 12/1991 | Urquhart | 34/268 |
| 5,113,600 | 5/1992 | Telchuk | 34/218 X |

*Primary Examiner*—John M. Sollecito
*Assistant Examiner*—Steve Gravini
*Attorney, Agent, or Firm*—Howard & Howard

[57] ABSTRACT

An improved paint drying oven for vehicles includes a "hold" zone with a radiant energy generating floor. The floor preferably is defined by an inner wall and an outer wall spaced beneath the inner wall. Heated air is passed into the space between the inner and outer walls, and heats the inner wall to a temperature such that it emits radiant energy into the oven. The other walls of the oven do not include any heat generating structure, and thus the vehicle is dried entirely by the radiant energy generating floor. This invention maintains a relatively constant temperature at the vehicle body, thus achieving the main goals of the hold zone.

15 Claims, 2 Drawing Sheets

PAINT DRYING OVEN WITH RADIANT ENERGY FLOOR

BACKGROUND OF THE INVENTION

The present invention relates to a paint drying oven for a vehicle which uses a radiant energy floor and to a method of drying paint on a vehicle using a radiant energy floor.

Paint drying ovens are used on vehicle production lines. A vehicle body is initially transported through a paint spray booth where paint is applied to the body. The vehicle body is then transported into a paint drying oven. During the curing or drying process, the vehicle body is transported through the paint drying oven while drying energy is applied to the vehicle body to dry the wet paint. For the purpose of this invention, the term "drying" is used synonymously with "curing."

Various factors influence the selection, operation and design of paint drying ovens. The oven must apply drying or heat energy to the vehicle body, while at the same time not disturbing the wet paint finish on the vehicle body. Also, it is desirable to maintain the vehicle body in its entirety at a single target temperature during drying. Thus, while convection heaters, which blow heated air onto the vehicle, have many desirable attributes in maintaining a relatively constant vehicle temperature, they have undesirable characteristics due to the volume of air being directed onto the wet paint. However, the other major type of drying ovens, radiant ovens, have not always been able to uniformly apply drying energy to the vehicle. The prior art radiant ovens have used radiant generators on the side walls or ceiling of the oven. In most vehicle bodies, more heat needs to be directed towards the lower part of the body compared to the upper part of the vehicle body. The upper vehicle body, such as the vehicle roof, etc., is typically formed of thinner metal, and thus requires less heat.

A typical paint drying oven for a vehicle is divided into two sections. The first section, a so-called "heat-up" section, initially heats the vehicle body to a relatively hot target temperature. The particular target temperature depends upon the type of paint being applied, however, it is usually above 200° F. In particular examples, for a primer paint oven target, temperatures of between 280° F. and 330° F. are achieved in the oven. For a color paint oven, target temperatures of between 250° F. and 290° F. are achieved. For an electro-coat oven, target temperatures of between 320° F. and 400° F. are achieved. Once the heat-up section has achieved this initial heating of the vehicle body, the vehicle body moves into a second portion typically known as a "hold" portion. In the hold portion, the vehicle is maintained at the target temperature achieved by the heat-up portion for a period sufficient to dry the paint surface.

In the prior art, the heat-up section has often been provided by radiant ovens. However, radiant ovens have typically not been believed to be capable of providing the hold function. As such, the hold function has almost always been accompanied by large air movement. For that reason, hold zones have typically used convection heating. This belief was due to the difficulty of maintaining a constant temperature across the vehicle with the conventional radiant energy ovens. Radiant ovens that were used in a hold zone were used with large air flow volumes to create turbulent air flow. This defeats the benefit of radiant ovens as described above.

SUMMARY OF THE INVENTION

A disclosed radiant energy paint drying oven emits radiant energy for drying a painted vehicle body from the oven floor.

The oven comprises a housing with side walls, an oven ceiling and an oven floor defining a heating chamber through which a freshly-painted vehicle is transported. The oven contains a radiant energy generating means in the oven floor. The oven floor includes a thin inner wall adjacent the heating chamber and an outer wall spaced below the inner wall. In a more preferred embodiment, an inventive insulation layer is disposed adjacent and in contact with the outer wall and remote from the inner wall. The inner and outer walls define a heating passage. Heated air is supplied to the heating passage, and heats the inner wall of the floor to a temperature sufficient to emit radiant energy therefrom. Wall temperatures of up to 800° F. may be expected. The radiant energy is emitted to the heating chamber, and dries a freshly painted vehicle body.

The inventive paint drying oven is most preferably utilized in a "hold" section of a drying oven. Even so, it should be understood that the invention has benefits in all areas of the oven. The radiant energy floor has provided a relatively constant temperature throughout the vehicle body. This is an unexpected result, and also solves problems that have been experienced in this area. As described above, in the prior art it has been difficult to achieve a relatively constant temperature in the hold section without convection heating. As also described, convection heating has undesirable characteristics with regard to disturbing the paint finish. As such, the use of the radiant oven floor as the sole supplier of radiant energy to the vehicle provides unexpected benefits.

In addition, since the radiant energy creating structures that have typically been required on the sidewalls are eliminated with this invention, the width of the drying oven may also be significantly reduced. The reduction of required space in any vehicle assembly environment is a valuable benefit.

The radiant energy oven preferably contains air supply ducts located in the upper lateral corners of the oven housing for delivering air to the heating chamber. The air supply ducts include inlet and outlet ducts which deliver and then exhaust a small amount of air to remove paint solvents from the air in the heating chamber.

In a method of drying paint according to this invention, radiant energy is produced in the floor of a radiant energy oven. A car having wet paint is transported along the longitudinal direction of the radiant energy oven. Radiant energy is produced by a radiant energy means as disclosed above, i.e., a pair of thin walls defining a passage through which heated air is passed. The inner wall of the radiant energy means is heated to a temperature wherein the inner wall emits radiant energy thereby supplying radiant energy to the heating chamber of the oven.

In a more detailed method according to the present invention, a vehicle having wet paint is initially passed into a drying oven and brought up to a target temperature, which is at least above 200° F. Once the vehicle has been brought up to this target temperature, it moves into a "hold" portion of the drying oven. The hold portion of the drying oven includes a radiant energy generating oven floor as described above. The radiant energy generating floor generates radiant energy to continue to heat the vehicle, and maintain it at the target temperature.

These and other features of the present invention will be best understood from the following specification and drawings, of which the following is a brief description.

DETAILED DESCRIPTION OF THE INVENTION

Figure 1:
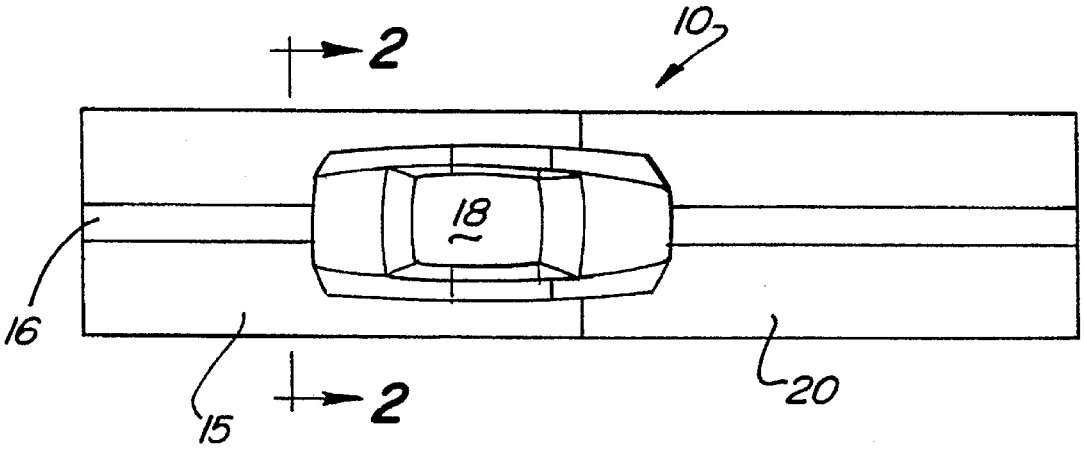
FIG. 1 is a schematic view of an inventive oven.

FIG. 1 shows a vehicle paint drying oven 10 incorporating a heat-up portion 15 which would include heating elements, which may be radiant energy generating elements, that initially heat a vehicle 18 to a target temperature. As discussed above, the target temperature differs with the type of paint applied on the vehicle, but is typically above 200° F. The vehicle 18 moves along a conveyor 16 through the heat-up section and into a second "hold" section 20. The goal of the "hold" section 20 is to maintain the vehicle at the target temperature achieved in the heat-up section 15. The hold section 20 incorporates an inventive radiant energy generating floor which maintains a vehicle 18 at the target temperature.

The floor may be heated as high as 800° F., depending upon the particular application and particular target temperature. A worker of ordinary skill in the art would be able to determine the required temperature for the floor to maintain the desired target temperature at the vehicle body 18.

Figure 2:
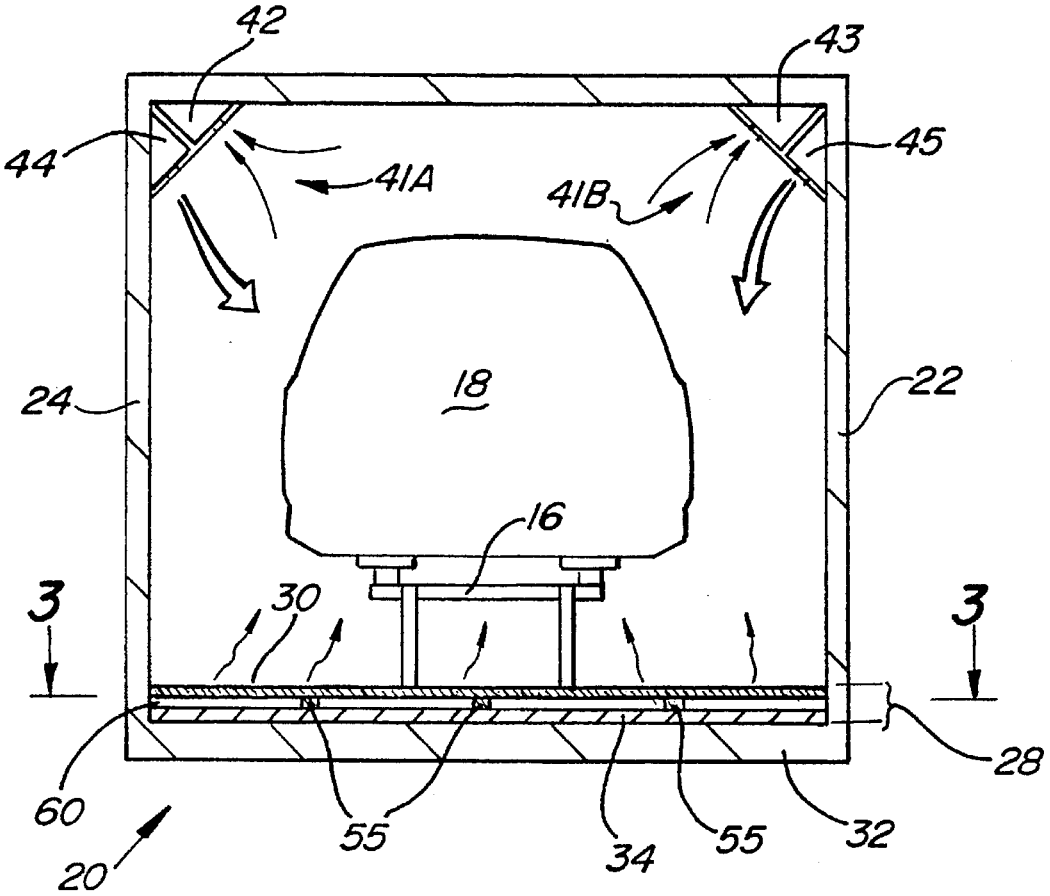
FIG. 2 is a cross-sectional view of a radiant energy paint drying oven of the invention herein.

FIG. 2 shows hold portion 20 having a radiant energy source in accordance with the invention, as will be described below. Although the inventive floor is shown in the hold zone, it should be understood that the invention has benefits at all oven locations. Portion 20 has a housing with opposed longitudinally extending side walls 22 and 24, a ceiling 26, and a floor 28. The opposed side walls 22 and 24 define a heating chamber of the oven through which a series of freshly painted vehicles are transported for drying. The materials for construction of the sidewalls and oven ceiling, are well known in the art and are not critical to the present invention.

Freshly painted vehicle 18 is shown mounted on a conveyor 16 which moves a series of such vehicles longitudinally through the length of the oven, above the oven floor 28. Conveyor 16 transports vehicles along a central corridor, at a lateral center between sidewalls 22 and 24.

Optional air supply ducts 41*a* and 41*b* are also shown in the upper lateral corners of the oven housing extending along the length of the oven. Inlet ducts 42 and 43 deliver a small amount of air to the heating chamber, and air outlet ducts 44 and 45 quickly exhaust that air. These air supply ducts provide circulation of a small amount of air to remove solvents in the air. The ducts could be incorporated into the walls or floor in alternative embodiments. The air supply ducts can be connected to any apparatus that can provide relatively clean, dust-free, and dry re-circulation of air. Blowers and fans of the type required herein are well-known in the art.

Oven floor 28 extends between sidewalls 22 and 24, and includes thin radiant inner wall 30, outer wall 32, and insulation layer 34. The thin radiant inner wall 30 is adjacent the heating chamber of the oven and stretches the length of the oven along a longitudinal direction. The outer wall 32 is spaced from the inner wall 30 and is adjacent and below the insulation layer 34. The inner wall preferably has a thickness between about 1/16 and 1/4 inches and comprises a thermally conductive material which radiates heat well. Because the outer wall carries an insulation layer, it may comprise the same material as the inner wall, which may be an appropriate steel. The thickness, however, of the outer wall may be greater than that of the inner wall. The insulation layer consists of known insulative material.

Because of insulation layer 34 adjacent and above outer wall 32, only inner wall 30 will radiate heat. Energy will not radiate from outer wall 32.

Figure 3:
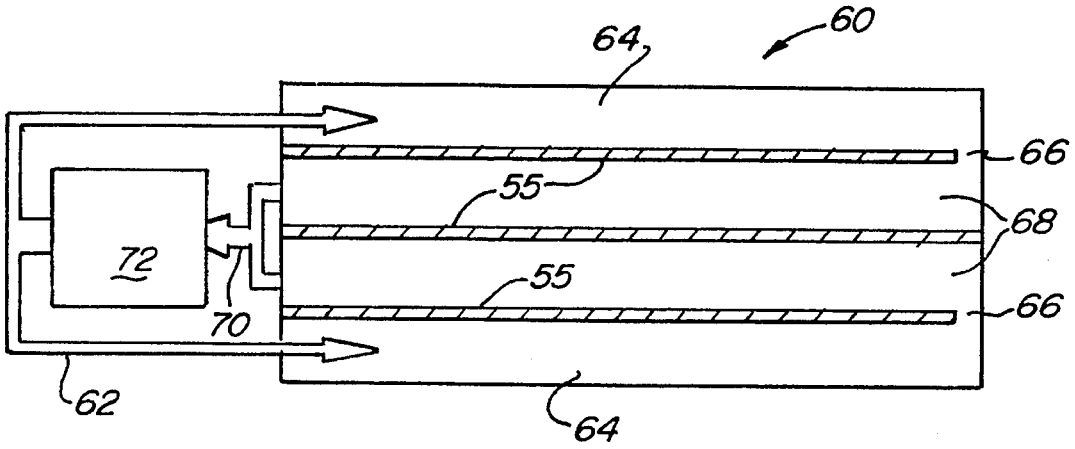
FIG. 3 is plan view of a radiant energy means comprising the floor of the radiant energy oven shown in FIG. 2 taken along section line 3—3.

As shown in FIGS. 2 and 3, the space 60 between the inner wall 30 and the insulation layer 34 includes a plurality of spacers, here three, which define a flow path for heated air. As shown, outer channels 64 carried heated air in a first direction along the oven to an end 66 of the outer spacers 55. The air then bends and returns along an inner channel 68. A conduit 62 carries the heated air to the channels 64, and a conduit 70 returns the air from outlet channels 68 to a heater 72. In this way, the air is heated to the desired temperature, and the floor is evenly heated to, in turn, apply a relatively uniform heat to the vehicle 18.

Preferably, the space 60 extends for a vertical extent between the insulation layer 34 and the inner wall 30 that is two to eight inches. Most preferably, the space is three to five inches.

Figure 4:
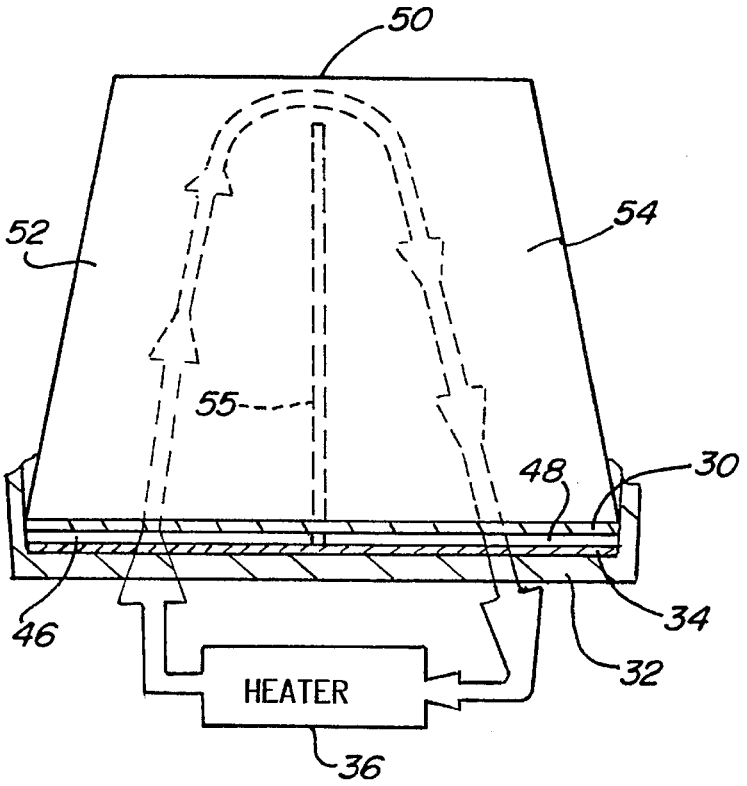
FIG. 4 is a view of an alternative floor air flow embodiment.

As shown in FIG. 4 in an alternative embodiment, the spaced inner and outer walls, 30 and 32 define a heating passage through which heated air is directed. Heated air supplied by heater 36 passes through the heating passage, heating inner wall 30. The air is then recirculated to the heater. The inner wall 30 is heated to temperatures up to 800° F. and emits radiant energy to the heating chamber of the oven. The heating passage contains a passage inlet 46, passage outlet 48, a left channel 52 and a right channel 54. The channels are defined by a single spacer 55. Heated air enters passage inlet 46, travels down left channel 52 running down the left side of the oven floor the length of the drying oven, makes a turn at the closed end of the oven floor 50, and travels back through the right channel the length of the drying oven and out heating passage outlet 48.

Heater 36 supplies heated air to the heating passage through heating passage inlet 46. After circulating through the heating passage, the air exits the heating passage through heating passage outlet 48 and recirculates through the heater 36 Heater 36 may be of a type well known in the art.

The heated air, as it travels through either embodiment heating passage, transfers heat energy to the thin inner radiant wall 30. Since inner wall 30 is relatively thin, it is easily heated to high temperatures. The hot inner wall emits radiant energy into the heating chamber.

The painted vehicle 18 travels on conveyor 16 through the heating chamber of the oven defined by the space between opposed sidewalls 22 and 24. The radiant energy in the heating chamber holds the vehicle at the target temperature, drying the paint on the vehicle to the extent that at the end of the oven, vehicle 18 has a dry paint coat.

In an inventive method of drying paint, radiant energy is emitted from a radiant energy means in the floor to the heating chamber of the oven. A vehicle having wet paint is moved through the heating chamber along the longitudinal direction of the oven.

The heating passage may comprise other configurations so long as it provides for the circulation of heated air from the heating means into a passage inlet through the heating passage configuration, out a passage exit, and back to the heating means. For example, the heating passage may be a single open-ended channel running between the inner and outer walls the length of the oven floor. The heating passage as illustrated in FIG. 3 could also be easily reversed with the heated air traveling along the laterally inner channels and returning in the laterally outer channels. The passage inlet would be at one end of the channel and the passage outlet would be at the other end, with the inlet and outlet are connected to a heating means in a recirculating fashion.

A preferred description of this invention has been disclosed; however, a worker of ordinary skill in the art would recognize that certain modifications would come within the scope of this invention. For that reason, the following claims should be studied in order to determine the true scope and content of this invention.

We claim:

1. A method of drying paint on a vehicle comprising:

(a) providing a floor of a radiant oven with a heating passage and communicating said heating passage to a source of heated gas, said radiant oven comprising opposed side walls spaced by a lateral distance and defining therebetween a heating chamber, an oven ceiling extending between the upper ends of said side walls, and said oven floor extending between the lower ends of said side walls, said heating passage being defined beneath said oven floor, and extending along a longitudinal direction;

(b) transporting a vehicle having wet paint thereon along said longitudinal direction through said heating chamber; and (c) sending heated gas into said heating passage, and passing said heating gas along said longitudinal direction, heating said oven floor and generating radiant energy to dry said wet paint.

2. The method as recited in claim 1, wherein said floor comprises a thin radiant inner wall adjacent said heating chamber, an outer wall spaced from said inner wall, and an insulation layer positioned adjacent said outer wall and remote from said inner wall, said insulation layer and said inner wall defining therebetween said heating passage.

3. A method of drying paint on a vehicle comprising:

(a) providing a drying oven and including a heat-up zone for initially heating a vehicle, and a hold zone positioned downstream from said heat-up zone, said hold zone including a floor with an inner wall spaced from an outer wall, with a space between said inner and outer walls being defined as a heating passage, said heating passage communicating with a source of heated gas;

(b) transporting a vehicle having wet paint into said heat-up zone, and causing said vehicle to be heated towards a target temperature that is above 200° F.;

(c) transporting said vehicle into said hold zone, and heating said vehicle in said hold zone to maintain said target temperature, said hold zone heating being achieved by the step of passing heated gas into said heat space to create radiant energy from said inner wall into said oven to heat said vehicle.

4. A method as recited in claim 3, further including the step of providing an insulation layer in contact with said outer wall, such that the majority of heat energy radiated from said floor radiates from said inner wall towards said vehicle.

5. A method as recited in claim 4, wherein said vehicle is transported through said oven on a conveyor, said conveyor being positioned directly above said inner wall.

6. A paint drying oven for a vehicle comprising:

(a) an oven housing extending along a longitudinal direction, and having opposed side walls spaced by a lateral distance and defining therebetween a heating chamber, an oven ceiling extending between upper ends of said side walls, and an oven floor extending between lower ends of said side walls, said floor comprising a thin inner wall below said heating chamber, an outer wall spaced below said inner wall, said outer and inner walls defining therebetween a heating passage;

(b) a means for providing heated gas to said heating passage for heating said inner wall to a temperature at which radiant energy is emitted to said heating chamber; and (c) a conveyor received in said oven housing and above said inner walls for transporting a vehicle through the longitudinal length of said oven through said heating chamber.

7. The oven as recited in claim 6 further comprising air supply ducts which deliver and exhaust air in the heating chamber, said ducts positioned in upper lateral corners of said oven housing.

8. The oven as recited in claim 6 wherein said heating passage comprises a passage inlet, a passage outlet, and a plurality of channels wherein alternating currents of heated gas pass through said channels between said passage inlet and passage outlet.

9. The oven as recited in claim 8 wherein said heating passage comprises two sets of two of said channels which run the longitudinal length of said oven, wherein a first of said channels in each set extends in a first direction along the length of the oven, and a second of said channels in each set extends in a direction opposed to said first direction along the length of the oven, and wherein said sets are spaced on each side of a lateral center of said oven.

10. The oven as recited in claim 6 wherein said heating means is connected in a recirculating fashion to a passage inlet and a passage outlet of said heating passage.

11. The oven as recited in claim 6, wherein an insulation layer is disposed above said outer wall.

12. The oven as recited in claim 6, wherein no heat is applied to said side walls, other than from said oven floor.

13. The oven as recited in claim 6, wherein said oven housing includes a first portion for initially heating a vehicle to a target temperature which is above 200° F., and a second portion downstream of said first portion wherein said vehicle is held at said target temperature, and said inner and outer walls being in said second portion.

14. A radiant energy oven for drying paint on a vehicle comprising:

(a) an oven housing extending along a longitudinal direction and having opposed side walls spaced by a lateral distance and defining therebetween a heating chamber, an oven ceiling extending between the upper ends of said side walls, and an oven floor;

(b) a radiant energy generating means associated with said oven housing, and including a thin radiant inner wall adjacent said heating chamber, said inner wall being said floor of said oven housing, an outer wall spaced from said inner wall, and an insulation layer above said outer wall and remote from said inner wall, said outer and inner walls defining therebetween a heating passage wherein said radiant energy means is located; and (c) a means for providing heated gas to said heating passage for heating said inner wall to a temperature at which radiant energy is emitted to said heating chamber.

15. The oven as recited in claim 14, wherein said oven housing includes a first portion for initially heating a vehicle to a target temperature which is above 200° F., and a second portion downstream of said first portion wherein said vehicle is held at said target temperature, and said inner and outer walls are in said second portion.

* * * * *